United States Patent [19]

Eriksson et al.

[11] Patent Number: 4,974,386

[45] Date of Patent: Dec. 4, 1990

[54] FRAME STRUCTURE WITH PROFILE MEMBERS AND ENGAGEMENT RODS

[75] Inventors: Arne Eriksson; Weine Hammarberg; Kurt Pettersson, all of Enköping, Sweden

[73] Assignee: AB Bahco Ventilation, Sweden

[21] Appl. No.: 223,665

[22] Filed: Jul. 21, 1988

Related U.S. Application Data

[63] Continuation of Ser. No. 32,379, Mar. 31, 1987, abandoned.

[30] Foreign Application Priority Data

Apr. 7, 1986 [SE] Sweden ..... 8601550

[51] Int. Cl.[5] ..... A47B 87/00; F16B 12/32

[52] U.S. Cl. ..... 52/282; 52/281; 312/111; 312/257 SK

[58] Field of Search ..... 312/111, 257 A, 257 SM, 312/257 SK; 52/656, 731, 720, 281, 282

[56] References Cited

U.S. PATENT DOCUMENTS

| | | | |
|---|---|---|---|
| Re. 17,440 | 9/1929 | Hauserman et al. | 52/731 |
| 1,345,002 | 6/1920 | Graff | 52/281 |
| 1,946,694 | 2/1934 | Hunter | 52/731 |
| 2,196,399 | 4/1940 | Rubel | 312/257 SK |
| 2,202,881 | 6/1940 | Winslow | 52/731 |
| 3,185,267 | 5/1965 | Pavlecky | 52/281 |
| 3,189,140 | 6/1965 | Luss | 52/720 |
| 3,280,523 | 10/1966 | Stroud et al. | 52/790 |
| 3,562,992 | 2/1971 | Kinsey | 52/731 |
| 3,881,428 | 5/1975 | Klecki | 312/257 A |
| 3,944,308 | 3/1976 | Persson | 312/111 |
| 4,395,080 | 7/1983 | Winn et al. | 312/111 |
| 4,637,324 | 1/1987 | Janson | 312/257 SK |

FOREIGN PATENT DOCUMENTS

| | | | |
|---|---|---|---|
| 226496 | 6/1987 | European Pat. Off. | 312/257 SK |
| 2026418 | 12/1970 | Fed. Rep. of Germany | 52/731 |
| 2357208 | 2/1978 | France | 312/257 SK |
| 2445872 | 9/1980 | France | 52/396 |
| 0620271 | 11/1980 | Switzerland | 52/720 |

*Primary Examiner*—Michael Safavi

[57] ABSTRACT

A sheet metal profile member (22) for the construction of a frame structure for a box-shaped casing for ventilation or air treatment devices. The sheet metal profile member has a substantially square cross-section with an internal cavity (23) and a guide flange (44), which is retracted in the region of an external corner edge (22*a*), so as to enable interconnection of adjoining frame structures both vertically and horizontally by means of a guide engagement rod (20).

6 Claims, 3 Drawing Sheets

FRAME STRUCTURE WITH PROFILE MEMBERS AND ENGAGEMENT RODS

This application is a continuation of application Ser. No. 07/032,379, filed Mar. 31, 1987 now abandoned.

The invention relates to a sheet metal profile member for the construction of a frame structure, which comprises sheet metal profile members and corner elements for a box-shaped casing, especially for air-treatment devices, such as fans, air filters, air humidifiers, heating or cooling apparatus, heat exchangers etc., which profile member is provided with a longitudinal guide flange formed integrally therewith to enable interconnection of two adjoining frame structures by means of a guide engaging rod, which engages and holds the guide flanges of two adjacent metal profile members.

Such a metal sheet profile member is known from SE-B-7609128-9. The known profile member enables an easy coupling of the apparatus casings located adjacent to each other, wherein the adjoining frames enclose mutually facing connection openings of the apparatus casings, and the profile members extending around the connection openings consist of bent metal sheet strips. The profile members have open cross-sections with two legs or flange portions extending from the double-folded flange serving as an engagement guide. One of the flange portions is intended to be connected to the adjacent, corresponding flange portion of an adjoining frame by means of special fasteners, such as screws or the like, whereas the second flange portion, which extends substantially perpendicularly to the first flange portion, provides support for the plate-like wall elements and shutters of the apparatus casing. The guide flange can be used instead of or as a supplement to the screw joint in the adjoining first flange portion Moreover, the open profile member can be supplemented with an essentially groove-shaped profile member to form a closed cross-section. Said cross-section is substantially rectangular with an obliquely retracted corner portion inside the first flange portion, providing a screw connection. The guide flange is located externally as a prolongation of the first flange portion on the outside of the closed, essentially rectangular cross-section. This type of profile member is used only around each connection opening of a casing whereas the remaining frame profile members have a simpler cross-section. Consequently, when building a frame structure for such an apparatus casing, several types of profile members must be combined as well as different types of corner elements adjusted to the different profiles Naturally, this makes the production more complicated and more expensive Furthermore, the coupling of different casings by means of guide rods can only be effected in one direction, that is horizontally, whereas the casings situated on top of each other must be secured bY other means.

In view of the above, the object of the invention is to provide such a sheet metal profile member that the same profile can be used for all twelve frame parts of an apparatus casing and the coupling of the adjoining casings by means of guide engagement rods can be made horizontally as well as vertically. Moreover, a frame structure built by metal profile members and corner elements should be tight as well as heat and sound insulating.

According to the invention, this object is achieved in that the sheet metal profile member has a closed, substantially square cross-section with an internal, heat and sound insulating cavity and in that the guide flange :s retracted in the region of an external corner edge of the sheet metal profile member.

By means of the substantially square cross-section and the retracted guide flange, a symmetrical arrangement is obtained that makes is possible to use the same kind of profile members for all the twelve frame parts of a frame structure for a box-shaped casing, and the same kind of corner elements can be used throughout. Then, the four profile members at each terminal or connection end can be oriented so as to permit horizontal coupling by means of guide engagement rods, whereas the other four, longitudinal profile members can be oriented for vertical coupling with an upper or lower apparatus casing, a stand or the like. Moreover, a good tightness and heat and sound insulation are achieved in the essentially square cavity, which can be of about the same thickness as the wall elements and possible shutters of the casing. If necessary to improve the insulating effect even more, the cavity can be filled with a suitable, preferably injectable insulating material.

In a preferred embodiment of the sheet metal profile member, the two insides extending from an internal corner edge, at the transition portion adjacent to the respective outside, form a step-like shoulder to permit the reception of a flange of a wall element or a shutter included in the casing. By this arrangement, the outside of the wall element or the shutter may be aligned to or located somewhat inside the outer plane of the profile members, which is advantageous from an esthetic as well as a practical point of view. Thus, adjacent sheet metal profile members can be coupled by means of guide engagement rods while keeping the outsides of the profile members in a roll-defined mutual contact Moreover, the wall element or shutter flanges and their sealing strips are well protected in the recessed shoulders.

Another contact surface for the wall elements and the shutters is obtained if the metal profile member at its internal corner edge is provided with an internal flange :n alignment with one of its insides. On the one hand, this flange may serve as an additional sealing surface if so required, and on the other hand, it may serve as an abutment for a pivotable lock bolt connected to a knob, a handle or the like at the outside of a shutter.

The guide flange retracted in the external corner region of the profile cross-section preferably extends obliquely from one outside of the profile member towards the other one, preferably up to a diagonal line, which connects the internal corner edge with the (imaginary) external corner edge.

From the point view of rational production, it is suitable to make the profile members of a single metal piece by rolling, wherein the cutting into exact predetermined lengths is preferably carried out in direct connection to the rolling process. Of course, it is possible to provide the metal profile members with a colour layer or plastic coating. Alternatively, they can be made corrosion resistant, by e.g., galvanization Preferably, the longitudinal joint of the metal sheet is located adjacent to the retracted guide flange, e.g. in that the latter is formed by three sheet metal layers, wherein the metal sheet material in one outside portion of the profile member is bent around the sheet metal material in the other outside portion. In this way, the guide flange can be made rigid and strong, so as to enable a secure coupling of adjoining apparatus casings.

The invention will be explained further below with reference to the attached drawings.

Figure 1:
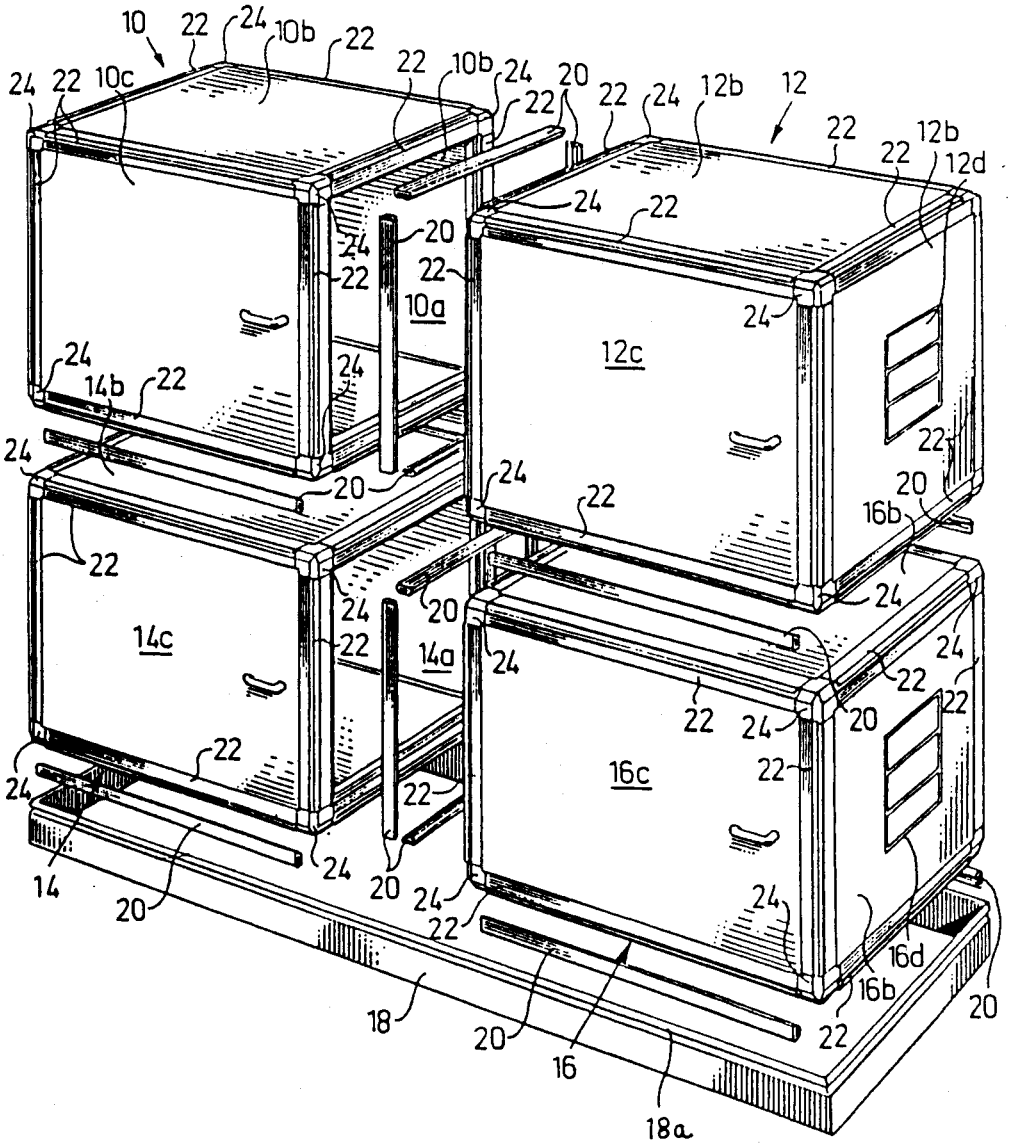
FIG. 1 shows in perspective view four apparatus casings to be coupled by means of guide engagement rods cooperating with the frame structures of the casings, comprising sheet metal profile members according to the invention.

Thus, FIG. 1 shows four box-shaped apparatus casings 10,12,14, 16 to be mounted on a bottom frame 18 by means of guide engagement rods 20 only. Each apparatus casing contains at least one air-treatment device, not shown, such as a fan, an air filter, an air humidifier, a heating or cooling unit, a heat exchanger or the like, and an air treatment assembly can be combined in different ways with such components being arranged horizontally and vertically in a desired number of apparatus casings.

In the example according to FIG. 1, the two lower casings 14,16 have adjoining, open connecting ends **14*a*,16*a*, and in a corresponding way, the two upper casings 10,12 have adjoining, open connecting ends 10*a*,12*a*, so that air may flow freely from one casing to the other in each pair of casings. The remaining sides of each casing 10,12,14,16 are sealed off by means of stationary wall elements 10*b*,12*b*,14*b*,16*b* and an openable shutter 10*c*,12*c*,14*c*,16*c*, the wall elements at the casing ends being provided with connection openings having dampers 10*d*,12*d*,14*d*,16*d* (only 12*d* and 16*d*** are visible in FIG. 1) to be connected to air ducts, e.g. intake air and exhaust air ducts.

As appears from FIG. 1, the various apparatus casings can be connected to each other by means of guide engagement rods 20 horizontally as well as vertically. Sheet metal profile members 22, which together with corner elements 24 form the frame structure of each casing, are so oriented that the mutually facing open ends of the upper casings 10,12 (and in the same way of the lower casings 14,18) can be coupled by means of four guide engagement rods 20, one along each side of the opening. Furthermore, the horizontal, adjoining frame parts can be coupled in a corresponding way, viz. with two opposite guide engagment rods, connecting the vertically piled casings 10,14, and 12,16, respectively. Likewise, in the same way, the lower casings 14 and 16 can be connected to the bottom frame 18, which for this purpose is provided with a circumferential guide flange **18*a***.

Figure 2:
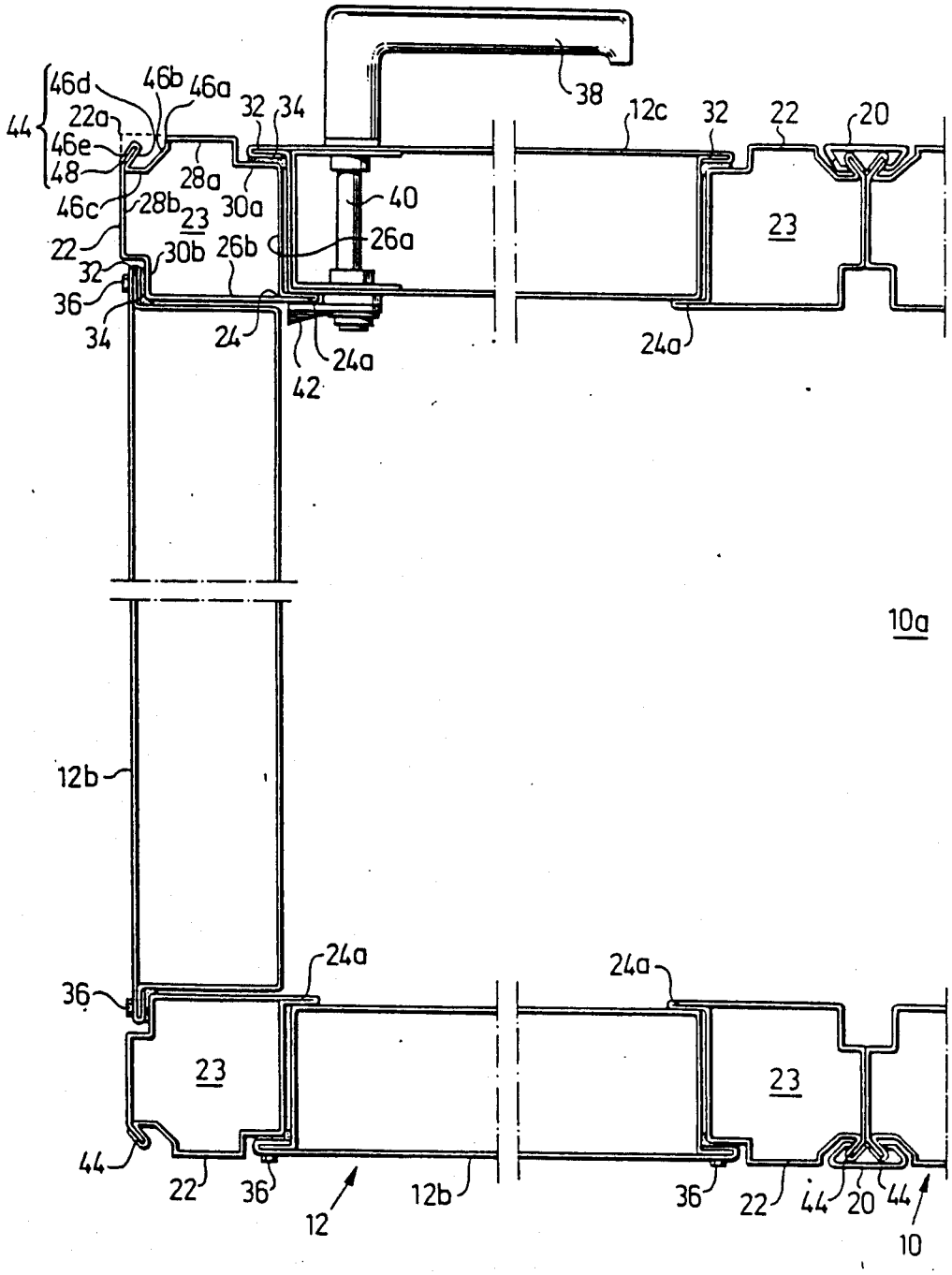
FIG. 2 shows a horizontal section through an apparatus casing according to FIG. 1.

The design of the sheet metal profile member 22 appears best from FIG. 2, illustrating, in a horizontal section through the casing 12 and a small part of the adjoining casing 10 (a horizontal section through the lower casings 18 and 14 would look alike), the vertical profile members 22 as well as the stationary wall elements **12*b* and the openable shutter 12*c***.

The sheet metal profile members 22 included in the frame structure of the casing are alike (in cross-section, although the lengths may differ corresponding to various length, width and depth of the casing) having essentially square cross-sections with an internal cavity 23. Two mutually perpendicular internal sides **26*a*,26*b*, forming a step-like groove or shoulder 30*a*,30*b* adjacent to the external sides 28*a* and 28*b*, respectively, extend from an internal corner edge 24. The shoulder is dimensioned so as to enable an external flange 32 on the stationary wall element 12*b* and on the shutter 12*c*, respectively, to be received in the shoulder and be seated tightly by means of a sealing strip 34, so that the outsides of the wall element 12*b* and the shutter 12*c* are situated slightly retracted relative to to the outsides 28*b* and 28*a*, respectively, of the profile member 22. The stationary wall elements 12*b* are secured by means of screws 36, whereas the shutter 12*c* is kept closed by means of at least one locking device with an external handle 38, which via a through-going shaft 40 is connected to a pivotable lock bolt 42, which cooperates with a flange 24*a* extending from the internal corner edge 24 of the profile member in alignment with the internal side 28*b*. Thus, this flange 24*a* is oriented in such a way that it does not affect the free internal opening between the mutually connected casings 10,12**, as appears from FIG. 2 to the right.

In the region of the external corner edge of the profile member 22, a guide flange 44 is formed so as to be situated inside the external edGe point **22*a* of the square profile cross-section. The guide flange 44 extends from the external side 28*b* obliquely (approximately 45°) towards the other external side 28*a* approximately to a point located on the diagonal between the internal and external edge points 24 and 22*a*, respectively, of the square cross-section. In this region, the external side of the sheet metal profile member is then retracted at a certain distance from the corner 22*a*, viz. in the form of a first, transversally inwardly extending portion 48*a* followed by a second portion 48*b* extending approximately 45° obliquely towards the other external aide 28*b* and a third portion 16*c* extending transversally to the external side 28*b*, and fourth and fifth portions 48*d* and 46*e*, respectively, enclosing an obliquely bent end portion 48 of the external side 28*b*. Thus, the sheet metal portions 46*d*, 48 and 46*e* form the guide flange 44 and make it rigid and strong enough to provide a secure connection by means of a guide engaging rod 20, whereas the retracted portions 46*a*,46*b* and 48*c* are dimensioned to provide enough space inside the guide flange 44 to receive one of the bent end portions of the guide engaging rod 20** with a certain play.

Figure 3:
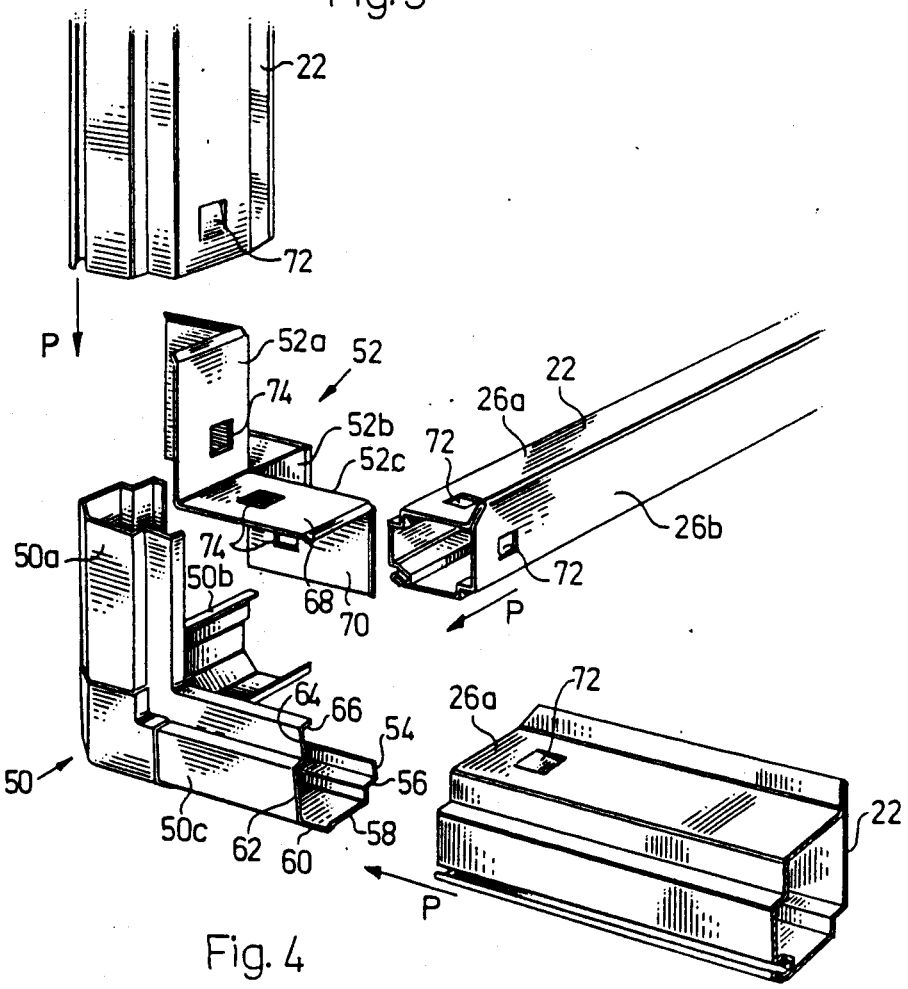
FIG. 3 shows in perspective view how three sheet metal profile members can be coupled to a corner element consisting of two loose parts.

The sheet metal profile rods 22 are preferably made by rolling, whereby they can be cut very exactly into desired lengths immediately upon the rolling process with such exact prefabricated sheet metal profile members, the mounting of frame structures and casings is facilitated in that a good fitting is obtained automatically. The mounting of the frame structures is also made easier in that at every corner point, three profile members 22, oriented as shown in FIG. 3, are slid on (arrows P) and secured by snap locking (72,74) onto the projections **50*a*,52*a*; 50*b*,52*b* and 50*c*,52*c*, respectively, of a corner element formed by an external and an internal part 50 and 52, respectively. Thus, the whole frame structure can be mounted without using welding Joints, screws or similar fasteners. The projection of the external corner element part 50 thus includes portions 54,56,58,60,62,64,86 corresponding to the profile member portions 26*b* (partly), 30*b*,28*b*,46*b*,28*a*,30*a* and 26*a* (partly), respectively, whereas the projection of the internal corner element part 52 has two mutually perpendicular legs 68,70, which are placed onto the portions 54 and 88 respectively, and fit internally in the region of the internal sides 28***b* and 26*a*, respectively, of the profile members 22.

The wall elements 12*b* and the shutters 12*c* are filled with insulating material, such as mineral wool, and the profile members 22 and the corner elements 50,52 can likewise be filled with insulating material, thus making the casing very well heat and sound insulated Thanks to the exact production with small tolerances, a good tightness is obtained and pressure drops and other losses can thus be reduced to a minimum.

Figure 4:
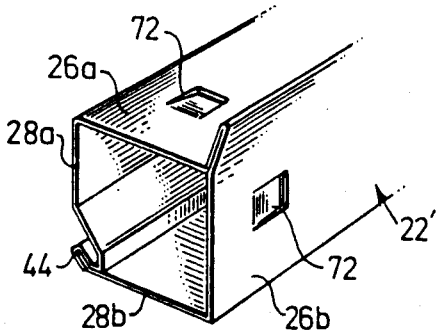
FIG. 4 shows a simplified embodiment of the sheet metal profile member according to the invention.

The particular design of the profile member can be varied with in the scope of the appended claim 1, for instance in that the step-like shoulders 30*a*,30*b*, serving as seats are omitted, as shown in FIG. 4, in which the profile member 22. otherwise has substantially the same cross-sectional profile (however the portion 46*a* has also been left out). Furthermore, the guide flanges 44 do not have to be straight and oblique but can be arcuately or sharply bent.

We claim:

1. A frame structure comprising:

two box-like substantially rectangular casings arranged next to each other; each casing comprising: twelve profile members of the same cross-sectional shape forming the edges of the casing, and eight corner elements respectively connecting three of said profile members at each corner of the casing; and four engagement rods respectively connecting two parallel adjoining profile members of said two casings; each profile member being a single elongated sheet metal member and having a closed cross-section defining an imaginary, substantially square contour with four equal sides; two adjacent sides of each profile member defining a recess along a first corner portion of said imaginary contour; each profile member having an elongated guide flange extending in said recess along said first corner portion; each elongated guide flange, as seen in cross-section, extending from one of said two adjacent sides obliquely towards the other one of said two adjacent sides of the respective profile member; and the guide flanges of said two parallel adjoining profile members being located next to each other and extending, as seen in cross-section, obliquely away from each other; each engagement rod having two longitudinally extending gripping portions respectively slidably engaging said guide flanges of said two adjoinging profile members.

2. A frame structure according to claim 1, wherein said two adjacent sides of the profile member define recessed shoulders at second and third diagonally opposite corner portions of said imaginary contour, for respectively receiving a flange of

3. A frame structure according to claim 1, comprising another flange extending outwardly from said imaginary contour at a second corner portion diagonally opposite said first corner portion, said other flange extending substantially in alignment with one of two sides of the profile member defining said second corner portion.

4. A frame structure according to claim 1, wherein said elongated guide flange, as seen in cross-section, extends to a diagonal connecting said first corner portion and a diagonally opposite corner portion of said imaginary contour.

5. A frame structure according to claim 1, wherein said profile member is a single rolled sheet metal member.

6. A frame structure according to claim 5, wherein said guide flange comprises three layers of said sheet, one layer being a first edge portion of said sheet, and the other two layers being a second edge portion of said sheet folded around said first edge portion.

* * * * *

UNITED STATES PATENT AND TRADEMARK OFFICE

CERTIFICATE OF CORRECTION

PATENT NO. : 4,974,386

DATED : December 4, 1990

INVENTOR(S) : Arne Eriksson; Weine Hammarberg; Kurt Pettersson; Odd Strand

It is certified that error appears in the above-identified patent and that said Letters Patent is hereby corrected as shown below:

On the title page item [75] should read as follows:

[75] Inventors: Arne Eriksson; Weine Hammarberg; Kurt Pettersson; Odd Strand, all of Enköping, Sweden

Signed and Sealed this

Twenty-fifth Day of August, 1992

*Attest:*

DOUGLAS B. COMER

*Attesting Officer*

*Acting Commissioner of Patents and Trademarks*